US005312309A

United States Patent [19]

Fox

[11] Patent Number: 5,312,309

[45] Date of Patent: May 17, 1994

[54] WRIST EXERCISER

[76] Inventor: Charles L. Fox, 163 Markville Road, Unionville, Ontario, Canada, L3R 4V7

[21] Appl. No.: 28,073

[22] Filed: Mar. 8, 1993

[51] Int. Cl.[5] ..... A63B 23/14

[52] U.S. Cl. ..... 482/45; 482/120

[58] Field of Search ..... 482/99, 44–48, 482/92, 93, 98, 102, 104–108, 148, 120

[56] References Cited

U.S. PATENT DOCUMENTS

| | | | |
|---|---|---|---|
| D. 264,237 | 5/1982 | McCaleb et al. | D21/198 |
| 684,688 | 10/1901 | Herz | 482/99 |
| 2,475,656 | 7/1949 | Bidak . | |
| 3,132,861 | 5/1964 | Horney | 482/46 |
| 3,806,121 | 4/1974 | Crossley . | |
| 3,858,873 | 1/1975 | Jones | 482/99 |
| 3,982,755 | 9/1976 | Sarich . | |
| 4,411,423 | 10/1983 | Estwanik, III . | |
| 4,438,920 | 3/1984 | Veillette . | |
| 5,037,087 | 8/1991 | Roth . | |
| 5,060,933 | 10/1991 | Cedro . | |

*Primary Examiner*—Stephen R. Crow
*Assistant Examiner*—Jerome Donnelly
*Attorney, Agent, or Firm*—Kenneth M. Garrett

[57] ABSTRACT

A wrist exercizing device comprises a pair of generally coaxial handles for grasping in the hands and turning, and a reel mounted therebetween. The reel has a reel surface that is eccentric with respect to the axis of rotation of the handles. A cord is wrapped round the reel surface and supports a weight. Rotation of the handles to raise or lower the weight requires a periodically varying effort. Suitably the reel surface has an axis of rotational symmetry that is offset from the axis of rotation of the handles to provide the eccentricity. The degree of offset may be varied so as to vary the ratio of maximum to minimum effort required to raise the load.

5 Claims, 3 Drawing Sheets

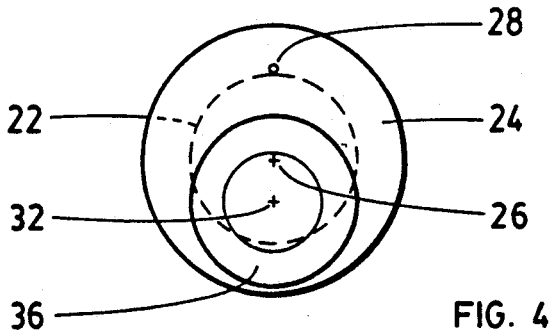
FIG. 4
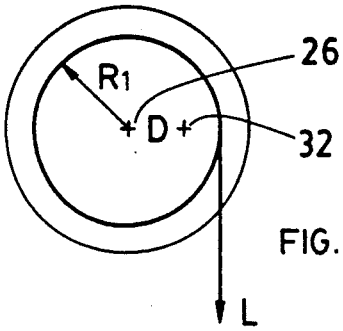
FIG. 5a
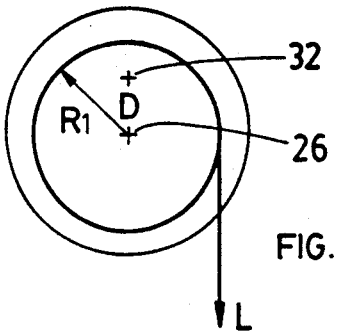
FIG. 5b
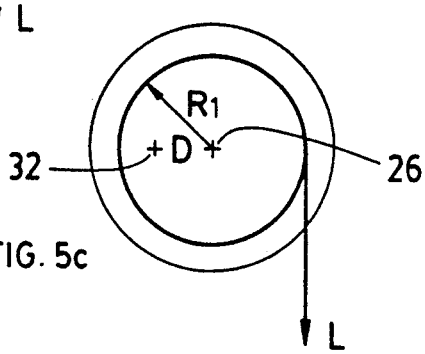
FIG. 5c
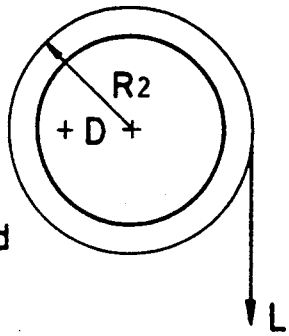
FIG. 5d
FIG. 6
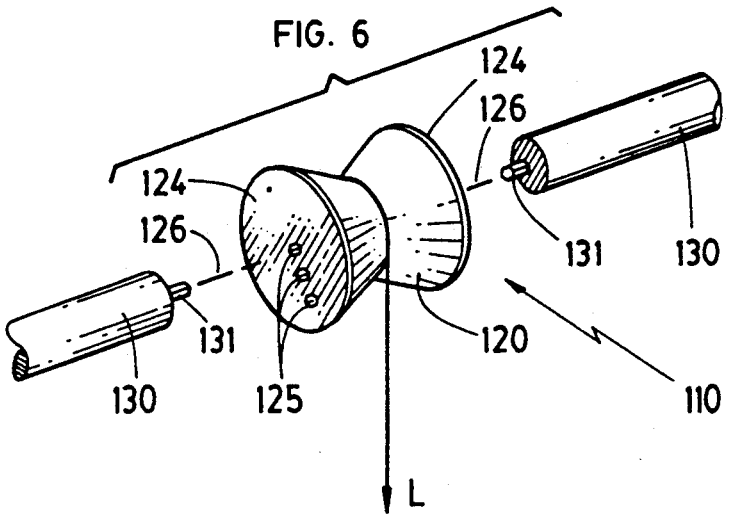

WRIST EXERCISER

FIELD OF INVENTION

This invention relates to devices commonly referred to as wrist exercizers.

BACKGROUND OF INVENTION

Devices of the foregoing nature are well known in the prior art, and commonly comprise a flexible member such as a cord for supporting a load, and a reel having a peripheral surface on which the cord is wound. The reel has axially opposed ends, and a pair of generally cylindrical handles for grasping project outwardly from the respective ends, the handles and peripheral surface all being concentric.

The device is used in various ways in exercizing the wrists, one common way involving the alternate rotation of the wrists through an angular interval of about 180 degrees in a manner to wind the cord onto the reel, thereby raising the load. In the majority of the prior art devices the reel has a rotational axis of symmetry, and the effort required to raise the load is constant. For those persons in whom the wrists have substantially different strengths, it is desirable that a different effort be required for each wrist.

Another common exercize involves flexing of the elbows and the wrists, with the device being held stationary relative to the hands. Again, this will engender the rotation of the device through an angle of approximately 180 degrees and accordingly a winding of the coil on the reel, requiring a first effort. It will additionally require a second effort from the elevation of the device as a whole. It is desirable to provide a means for changing the ratio of the first and second efforts, according to the relative degree of efforts desired to be applied through the wrists and the forearms.

It is an object of my invention to provide an improved wrist exercizing device of increased versatility for exercizing.

It is another object of my invention to provide an improved wrist exercizing device wherein the effort to lift a given load varies with rotation of the device between a maximum and a minimum value.

It is still another object of my invention to provide an improved wrist exercizing device of the foregoing type wherein the ratio between the maximum and minimum values can easily be presettably selected.

SUMMARY OF THE INVENTION

In accordance with one aspect of my invention, in a wrist exercizing device which includes a flexible member for supporting a load, a reel having a peripheral surface on which the flexible member is wound and ends from which project generally cylindrical handles for grasping, the handles having a common axis about which the reel is rotated to wind the flexible member onto the reel, the peripheral surface is eccentric relative to the cylindrical axis of the handles, having a first portion of minimum eccentricity and a second portion of maximum eccentricity diametrically opposed thereto, with portions intermediate the first and second portions having intermediate eccentricity. Accordingly, the effort necessary to raise the load varies with the rotation of the handles about their common axis, to pass through either a maximum or a minimum value for any 180 degrees interval of rotation.

Expediently, and in accordance with the illustrative embodiment, the reel has a rotational axis of symmetry, which is to say that it has a right circular cross section and the axis of the handles is offset from the axis of symmetry of the reel to provide the desired eccentricity.

Optionally, means is provided for selectively changing the offset, and accordingly, for changing the maximum value of effort and the minimum value of effort for raising a given load, which will correspondingly change with the ratio of the efforts.

Suitably, the distal ends of the handles are enlarged to facilitate the exercize device being held by pressure applied in an axial direction through the palms of the hands of a user, rather than by grasping the handles, thereby providing a still greater versatility of use of the device.

These foregoing objects and aspects of the invention, together with other objects, aspects and advantages thereof will be more apparent from the following description of a preferred embodiment thereof, taken in conjunction with the following drawings.

BRIEF DESCRIPTION OF THE DRAWINGS

FIG. 4 is a side elevation of the exercizer of FIG. 2;

FIGS. 5*a*, 5*b*, 5*c* and 5*d* show the wrist exercizer of FIG. 1 schematically in mid axial section with varying degrees of rotation, and FIG. 6 is similar to FIG. 1 but shows central portions of a modified embodiment of my invention in exploded view.

DESCRIPTION OF THE PREFERRED EMBODIMENT

Figure 1:
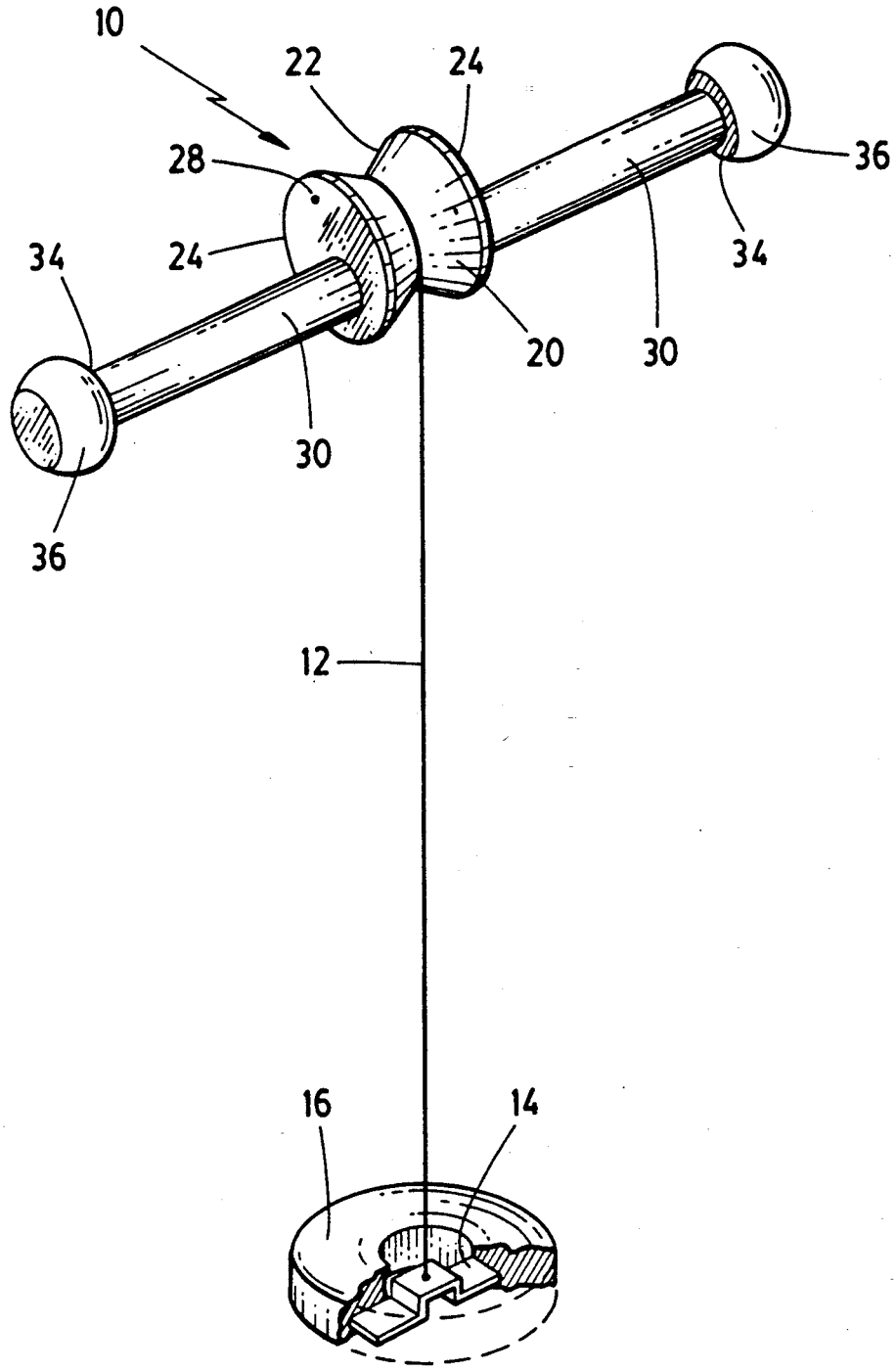
FIG. 1 shows a wrist exercizer in accordance with my invention in perspective view, partially broken away to reveal detail.
Figure 2:
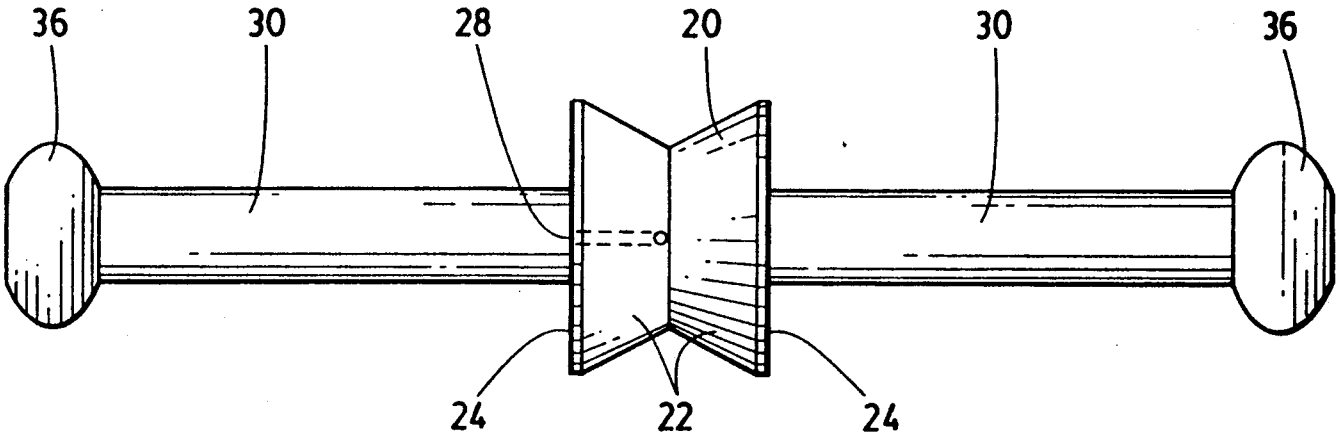
FIG. 2 is a front elevation of the exercizer of FIG. 1.
Figure 3:
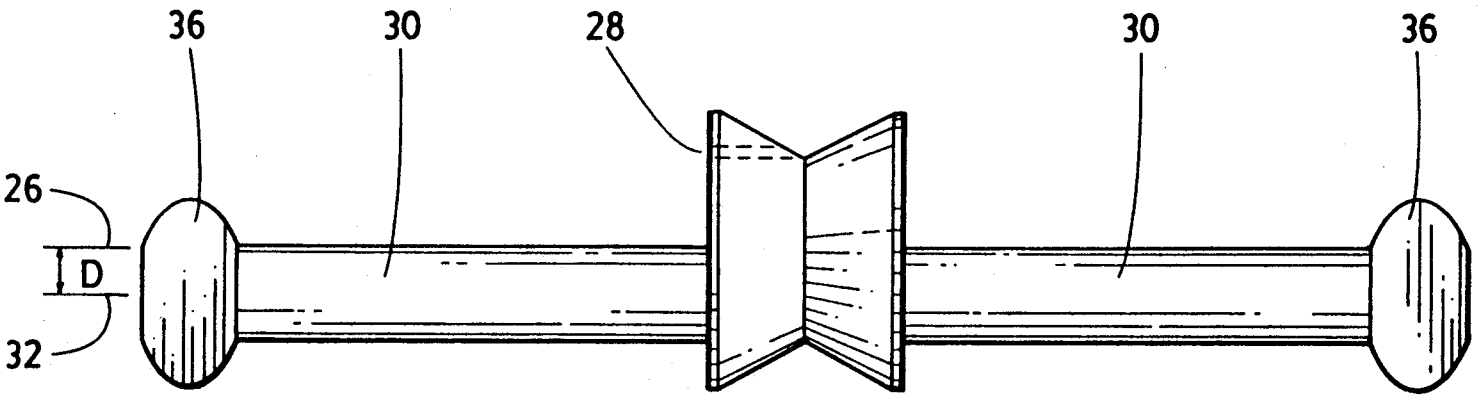
FIG. 3 is a plan view of the exercizer of FIG. 2.

Referring to the drawings in detail, a wrist exercizing device is identified generally therein by the numeral 10. Device 10 comprises a cord 12 having a bracket 14 attached at one end thereof for supporting a donut type weight plate 16 of a type which is commonly used for barbells and the like, to form a load L. Device 10 further comprises a reel 20 having a peripheral surface 22 and axial ends 24. Reel 20 has a symmetrical axis of rotation 26 thereto. A small opening 28 is formed between surface 22 and axial end 24 to permit the attachment of cord 12 to reel 20. Surface 22 comprises a pair of truncated cones whereby it has a V form in axial cross section with a minimum radius $R_1$ and a maximum radius $R_2$.

Device 10 also comprises handles 30, which are generally cylindrical having a diameter suitable for the handles to be firmly grasped by the hands of a user. Handles 30 have a common cylindrical axis 32 and are respectively disposed on ends 24 so that axis 32 is parallel to axis 26 and offset therefrom by a distance D.

The distal ends 34 of handles 30 are provided with bulbous enlargements 36.

Device 10 may be used in several different ways to exercize the wrists, hands and arms of the user. In accordance with one method of use, alternate handles 30 are rotated through approximately 180 degrees by a rotational movement of alternate wrists. Considering device 10 in its rotational position shown in FIG. 5*a*, wherein axes 26 and 32 are in horizontal alignment, with cord 12 closest to axis 32, the moment of load L about axis 32 will be equal to $(R_1-D)$, which will also define the eccentricity of surface portion 36, which will be a minimum for the device. As device 10 is rotated anticlockwise through an arc of 90 degrees to the rotational position shown in FIG. 5*b*, the moment about axis 32 will increase progressively until it becomes equal to $R_1$. The moment will continue to increase with rotation of device 10 through a increment of further 90 degrees to its position shown in FIG. 5*c*, when the moment about axis 32 will be equal to $(R_1+D)$, which will also define the eccentricity of surface portion 38, and which will be a maximum for the device. Expert users may, however, increase the moment somewhat further by skewing device 10 whereby cord 12 will skew across peripheral surface 22 to wind on a portion thereof having a radius up to the radius $R_2$, in which case the maximum moment becomes equal to $(R_2+D)$, as suggested in FIG. 5*d*. Generally speaking, a user will commence the exercize with the reel in the position shown in FIG. 5*b*, whereby the effort passes alternately through a maximum and a minimum value with successive rotational intervals of 180 degrees.

In another form of exercize using device 10, the device is held by the user applying a pressure in an axial direction to distal ends 34 using the palms of the hands, the bulbous ends 36 serving to reduce the pressure that must be applied. Still other forms of exercize will be apparent to users of device 10.

Where $R_1$ is relatively large, the ratio $(R_1+D)$ $(R_1-D)$ which defines the maximum effort to the minimum effort to lift load L by rotational movement of device 10 about axis 32, may also be relatively high, and the maximum effort required may be too great for some users or the minimum effort too low to provide useful exercize. The ratio of the efforts is easily changed by providing means for varying the offset of axis 32 from axis 26. In accordance with FIG. 6, a device 110 includes a reel 120 with ends 124 each of which are provided with a plurality of openings 125, which openings are increasingly offset from the central axis 126 of reel 120. Handles 130 are provided with spigots 131 for engagement in selected ones of openings 125 having a desired offset.

It will be apparent that many changes may be made to the illustrative embodiment while falling within the scope of the invention, and it is intended that all such changes be covered by the claims appended hereto.

I claim:

1. A wrist exercising device for suspending between the hands of a user comprising:

an elongated flexible member for supporting a load;

a reel having a peripheral surface onto which said flexible member is windable through a plurality of turns, said reel having a pair of opposed ends;

a pair of generally cylindrical handles respectively disposed on said ends of said reel, said handles having a common axis defining the axis of rotation of said device, rotation of said handles about said axis serving to rotate said reel and wind said flexible member on said peripheral surface to raise said weight, the improvement wherein said peripheral surface is eccentric in relation to said common axis, having a first portion of minimum eccentricity and a second portion of maximum eccentricity diametrically opposed thereto, with portions of said surface intermediate said first and second portions having intermediate eccentricity, whereby the effort necessary to raise said load varies with the rotation of said handles about their common axis to pass through either a maximum or a minimum value for any 180° interval of rotation and wherein said reel has a central axis of rotational symmetry parallel to said common axis and offset therefrom.

2. The improved wrist exercizing device of claim 1, wherein means is provided for selectively varying said offset.

3. The improved wrist exercizing device of claim 1, wherein said handles each have an enlarged distal end.

4. The improved wrist exercizing device of claim 3, wherein each said distal end is bulbous.

5. The improved wrist exercizing device of claim 1, wherein said peripheral surface has a V form in axial cross section.

* * * * *